United States Patent [19]

Zak

[11] Patent Number: 4,690,271

[45] Date of Patent: Sep. 1, 1987

[54] TRAVEL CASE WITH SCREW-IN CONTAINERS

[76] Inventor: Deborah K. Zak, 130A S. State St., Apt. C, Newtown, Pa. 18940

[21] Appl. No.: 419,965

[22] Filed: Sep. 20, 1982

[51] Int. Cl.[4] ..... B05C 17/00; B65D 21/00

[52] U.S. Cl. ..... 200/1.7; 200/486; 200/508; 200/559

[58] Field of Search ..... 206/482, 487, 508, 1.7, 206/560, 1.8, 477, 486, 559

[56] References Cited

U.S. PATENT DOCUMENTS

| | | | |
|---|---|---|---|
| 2,804,226 | 8/1957 | Freedman | 206/1.7 |
| 3,023,884 | 3/1962 | Schwartz | 206/1.7 |
| 3,091,361 | 5/1963 | Gawron | 206/508 |
| 3,272,671 | 9/1966 | Gaylord et al. | 206/508 |
| 3,404,811 | 10/1968 | Cernei | 206/508 |
| 3,467,259 | 9/1969 | Silver | 206/1.7 |
| 3,624,789 | 11/1971 | Peyser et al. | 206/508 |

FOREIGN PATENT DOCUMENTS

| | | | |
|---|---|---|---|
| 961606 | 4/1957 | Fed. Rep. of Germany | 206/508 |

*Primary Examiner*—Joseph Man-Fu Moy

*Attorney, Agent, or Firm*—Florence U. Reynolds

[57] ABSTRACT

The containers have screw threads on their lower extremities which mate with corresponding screw-threaded elements integral with a rigid bottom of the travel case. These elememts may be projections or indented receptacles. The containers may be screwed to each other when removed from the case.

5 Claims, 4 Drawing Figures

FIG. 1
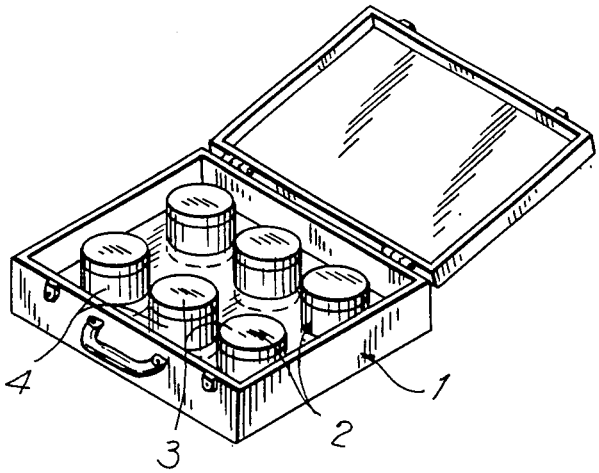
FIG. 2
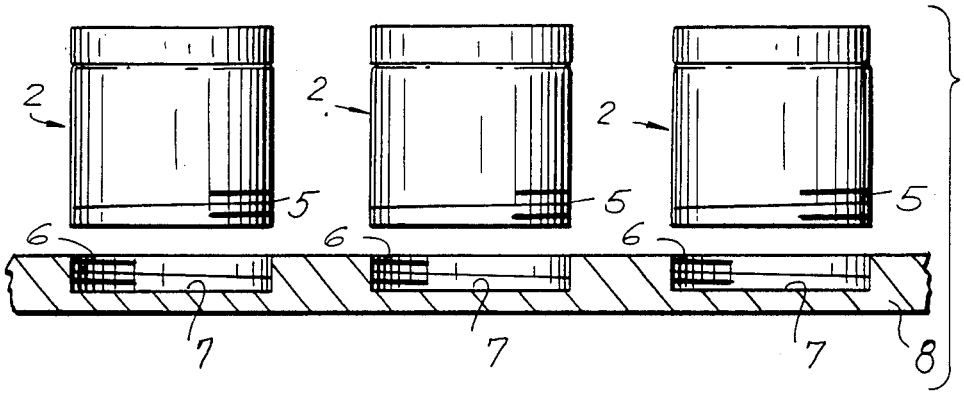
FIG. 3
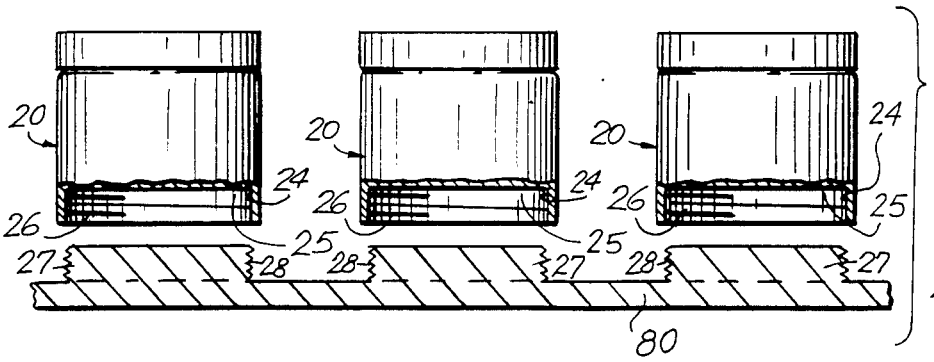
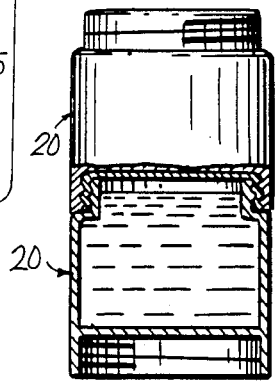
FIG. 4

TRAVEL CASE WITH SCREW-IN CONTAINERS

BACKGROUND OF THE INVENTION

This invention relates to a travel case fitted with screw-in containers for cosmetics, pills, artists' supplies, office supplies, sewing supplies, and the like.

Various types of travel cases for cosmetics or artists' paints and the like are known. Some have no provision for holding the containers for these materials in place and rely only on tight packing to hold them in place. Often the containers become jumbled together with rough handling of the case and have to be rearranged prior to use.

Other cases contain straps or depressions intended to keep the containers in place. However, these are not entirely satisfactory. The straps must be loosened prior to use. The depressions only prevent sideways movement but not vertical movement. Therefore they are not effective unless the cover of the case fits so tightly as to prevent such vertical movement.

SUMMARY OF THE INVENTION

The present invention overcomes the deficiencies of prior art travel cases for cosmetics or artists' supplies and the like by providing containers with screw threads on their lower extremities which mate with corresponding screw-threaded elements integral with a rigid bottom of the travel case. The containers may have the threads on their exterior and screw into threaded receptacles in the bottom of the travel case or, conversely, the containers may have indented bottoms with screw threads on the inner periphery thereof. These then screw onto threaded projections integral with the bottom of the travel case.

An additional advantage of the travel case according to the invention is that it makes possible easy interchange of items according to need, e.g., one set of cosmetics for day use and another for evening use, without the necessity of a separate case for each.

BRIEF DESCRIPTION OF THE DRAWINGS

FIG. 1 is a perspective view of a travel case according to the invention.

FIG. 2 is an exploded view of one embodiment of the invention showing a cross-section of the bottom of the travel case and an elevational view of the containers.

FIG. 3 is an exploded view of another embodiment of the invention showing a cross-section of the bottom of the travel case and a partial cross-section of the containers.

FIG. 4 is a partial cross-section of a stack of containers as shown in FIG. 2.

DETAILED DESCRIPTION

In FIG. 1, a travel case 1 is fitted with a plurality of containers 2 having covers 3 on the bodies 4 of the containers.

In FIG. 2, the containers 2 have screw threads 5 around their lower extremities. These mate with corresponding screw threads 6 on the inner surface of receptacles 7 formed in the rigid bottom 8 of the travel case.

In FIG. 3, the containers 20 have indented bottoms 25 which have screw threads 26 on their inner walls 24. These screw onto projections 27 integral with the bottom 80 of the travel case and have mating screw threads 28 around their periphery.

FIG. 4 shows a stack of containers as in FIG. 3 which have been removed from the travel case and screwed to each other. This is made possible by the identical size of the containers with respect to their circumference and identity of the pitch of the screw threads. This embodiment permits compact storage or transport in a different case such as a suitcase or tote bag.

In FIGS. 2 and 3, the rigid bottom of the case is shown in metal but plastic or wood would be equally satisfactory. The containers could be of glass, plastic or metal as desired.

Naturally, the containers must be round in shape in order to be able to be screwed onto or into threaded elements in the case or to be stacked as in FIG. 4.

What is claimed is:

1. An enclosed travel case comprising a substantially rigid bottom wall, at least one covered round container which fits within said case and has screw threads on its lower extremity, and a mating threaded element integral with said bottom wall on the inside of said case, whereby said container may be screwed to the threaded element in the bottom wall of said case.

2. The travel case according to claim 1, comprising a plurality of said containers and a corresponding number of said threaded elements.

3. The travel case according to claim 1 or 2, wherein each threaded element is a receptacle in said bottom wall and has screw threads on its inner walls and wherein each container has mating screw threads on the outer surface of its lower extremity.

4. The travel case according to claim 1 or 2, wherein each threaded element is a projection on said bottom wall and has screw threads on its outer wall and wherein each container has an indented bottom with mating screw threads on the inner wall of said indented bottom.

5. The travel case according to claim 4, wherein each container has screw threads around its upper extremity, which mate with the threads on the inner wall of the indented bottom and wherein the respective screw threads of all of the containers have the same circumference and pitch so that said containers may be screwed together in a stack when removed from said case.

* * * * *